US007915825B2

(12) United States Patent
Wyner

(10) Patent No.: US 7,915,825 B2
(45) Date of Patent: Mar. 29, 2011

(54) STARTING AID FOR DISCHARGE LAMP

(75) Inventor: Elliot F. Wyner, Peabody, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 514 days.

(21) Appl. No.: 11/728,564

(22) Filed: Mar. 26, 2007

(65) Prior Publication Data

US 2008/0106195 A1 May 8, 2008

Related U.S. Application Data

(60) Provisional application No. 60/857,443, filed on Nov. 7, 2006.

(51) Int. Cl.
*H01J 17/44* (2006.01)

(52) U.S. Cl. ..... 313/594; 313/623

(58) Field of Classification Search ..... 313/572, 313/573, 574, 623, 624, 625, 318.12, 570, 313/594, 595, 607
See application file for complete search history.

(56) References Cited

U.S. PATENT DOCUMENTS 4,360,758 A * 11/1982 Thornton et al. ..... 313/27
4,721,888 A 1/1988 Proud et al. ..... 315/60
4,812,714 A 3/1989 Keeffe et al. ..... 315/60
4,818,915 A 4/1989 Zaslavsky et al. ..... 315/60
5,323,091 A 6/1994 Morris ..... 315/344
6,392,343 B1 * 5/2002 Luijks et al. ..... 313/570

* cited by examiner

*Primary Examiner* — Toan Ton
*Assistant Examiner* — Andrew J Coughlin
(74) *Attorney, Agent, or Firm* — William H. McNeill

(57) ABSTRACT

An arc discharge lamp (10) having an arc tube (12) containing an arc generating and sustaining medium (13) and first and second spaced apart electrodes (14, 16), respectively. An envelope (18) surrounds the arc tube (12) and contains an atmosphere (19) within it. The atmosphere is of a composition and pressure that will provide a burst of UV radiation in response to a spark generated within the envelope (18) and, in a preferred embodiment of the invention, is selected from argon or nitrogen (with nitrogen being preferred) at a pressure of from 150 to 400 torr. First and second electrical lead-ins (20, 22) are sealed within the envelope (18), with the first lead-in (20) being electrically connected to the first electrode (14) and the second lead-in (22) being connected to the second electrode (16), for example, by connector wire (22*a*). Means (30) is contained within the envelope (18) and exposed to the atmosphere (19) for generating a UV-producing spark within the atmosphere (19). As shown in the embodiment of FIG. 1 the means (30) comprises an isolated pin (24) mounted in the seal area (26) of the arc tube (12) adjacent the first electrode (14), a resistor (28) electrically connected between the second lead-in (22) and the isolated pin (24). A spark gap G is formed between the first electrode (14) and the isolated pin (24).

11 Claims, 3 Drawing Sheets

| LAMP, 320 WATT ARC GAP | ZERO HOUR AMBIENT TEMP. TIME (SEC) | 100 HOUR AMBIENT TEMP TIME (SEC) | 100 HOUR -30C TIME (SEC) |
|---|---|---|---|
| 1 mm | 0.3 | 0.3 | 0.4 |
| 2 mm | 0.2 | 0.3 | 0.3 |
| 3 mm | 0.0 | 0.2 | 0.5 |
| Control | 54.3 | 5.9 | 19.6 |
| No UV enhancer | 2.3 | 14.6 | 97.7 |

Fig. 4

STARTING AID FOR DISCHARGE LAMP

CROSS-REFERENCE TO RELATED APPLICATION

This application claims priority from Provisional Patent Application No. 60/857,443, filed Nov. 7, 2006.

TECHNICAL FIELD

This invention relates to arc discharge lamps and more particularly to starting aids for such lamps.

BACKGROUND ART

Arc discharge lamps, such as metal halide lamps, are very efficient light sources. Because of the difficulty in beginning the arc discharge various forms of starting aids have been employed. For example, in mercury lamps it has been the practice to use a probe that penetrates the arc chamber. When a voltage is supplied to the lamp a low current discharge occurs between the probe and an adjacent electrode. This low current discharge initiates electrode-to-electrode current conduction, thus starting the lamp. This technique has been used also in metal halide lamps, particularly those having fill pressures below 50 torr of a rare gas. The relatively low pressure leads to arc tube blackening during starting and, additionally, the probe must be electrically neutralized after starting to avoid pinch seal failure by electrolysis. Typically, this is accomplished by means of a bi-metal switch.

In recent years the industry has changed to metal halide lamps that use elevated fill pressures that do not use probes. The ballast for this type of lamp produces high voltage starting pulses for ignition. However, these higher-pressure lamps have slow and erratic starting absent some form of starting aid.

One form of starting aid employs radioactive Kr85, which is injected into the arc tube as a low percentage of the total rare gas fill, and which act to initiate breakdown. However, use of radioactive materials requires specialized equipment in manufacturing as well as significant expense to document compliance with regulatory agency control in manufacturing and transportation.

The starting aid usually employed is a sealed glass capsule containing conditions that generate a burst of UV energy. This technique is described in U.S. Pat. No. 4,721,888 to Proud, et al. In practice, electroded UV capsules such as that disclosed in U.S. Pat. No. 4,818,915 and electrodeless capsules such as that disclosed in U.S. Pat. No. 4,812,714 have been used. While these work very well, they are expensive to manufacture and difficult to automate. Another UV source is disclosed in U.S. Pat. No. 5,323,091 in which the UV source is incorporated into the seal area of the arc tube.

DISCLOSURE OF INVENTION

It is, therefore, an object of the invention to obviate the disadvantages of the prior art.

It is another object of the invention to provide a simple UV source for starting arc discharge lamps.

Yet another object of the invention is the provision of a starting aid for arc discharge lamps that is relatively easy to automate.

These objects are accomplished, in one aspect of the invention, by an arc discharge lamp having: an arc tube containing an arc generating and sustaining medium and first and second spaced apart electrodes: an envelope surrounding the arc tube and an atmosphere within the envelope; first and second electrical lead-ins sealed within the envelope, the first lead-in being electrically connected to the first electrode and the second lead-in being connected to the second electrode; the improvement comprising: means contained within the envelope and exposed to the atmosphere for generating a UV-producing spark within the envelope atmosphere.

BRIEF DESCRIPTION OF THE DRAWINGS

FIG. 4 is a table comparing various lamp starting times.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
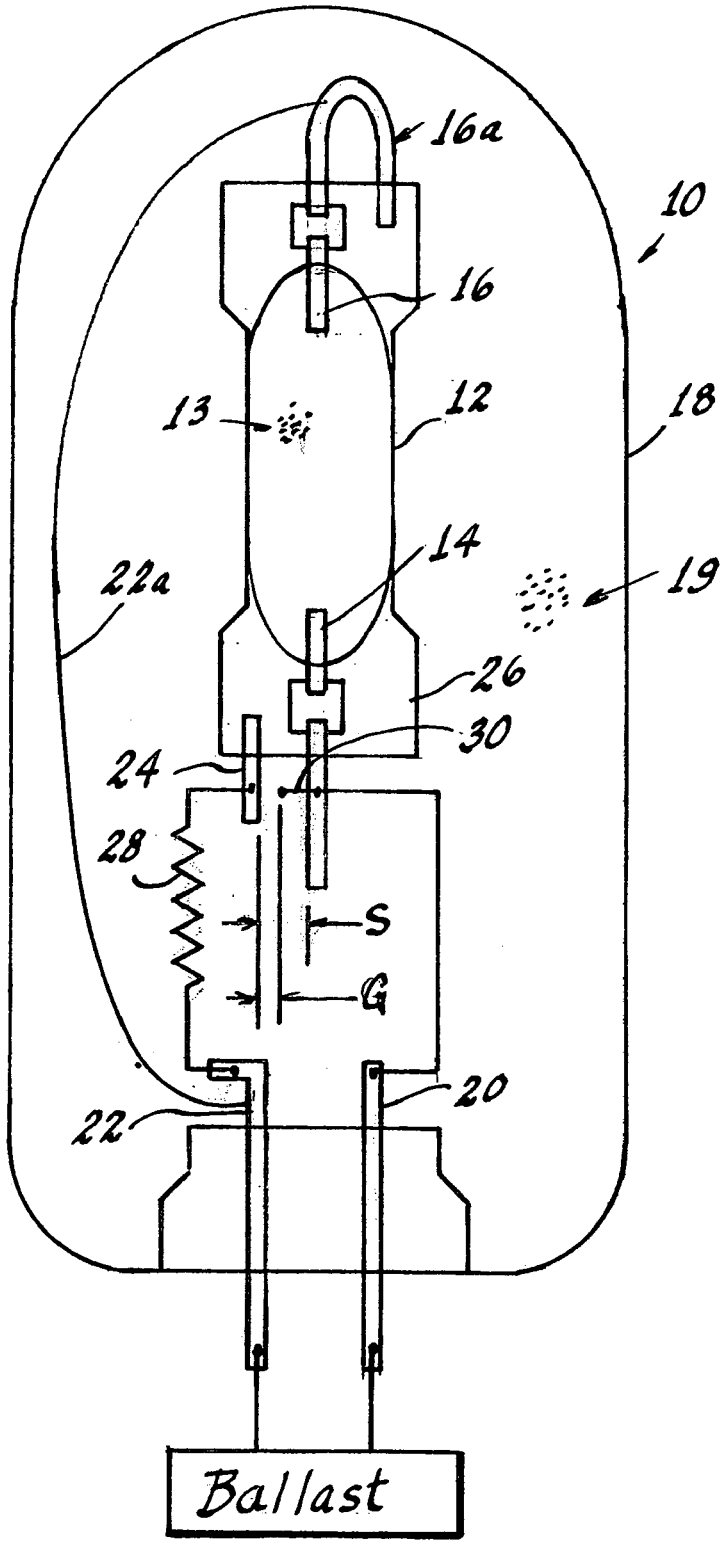
FIG. 1 is a diagrammatic elevational view of an embodiment of the invention.

Referring now to the drawings with greater particularity, there is shown in FIG. 1 an arc discharge lamp 10 having an arc tube 12 containing an arc generating and sustaining medium 13 and first and second spaced apart electrodes 14, 16, respectively. An envelope 18 surrounds the arc tube 12 and contains an atmosphere 19 within it. The atmosphere is of a composition and pressure that will provide a burst of UV radiation in response to a spark generated within the envelope 18 and, in a preferred embodiment of the invention, is selected from argon or nitrogen (with nitrogen being preferred) at a pressure of from 150 to 400 torr.

First and second electrical lead-ins 20, 22 are sealed within the envelope 18, with the first lead-in 20 being electrically connected to the first electrode 14 and the second lead-in 22 being connected to the second electrode 16, for example, by connector wire 22*a*. Means 30 is contained within the envelope 18 and exposed to the atmosphere 19 for generating a UV-producing spark within the atmosphere 19. As shown in the embodiment of FIG. 1 the means 30 comprises an isolated pin 24 mounted in the seal area 26 of the arc tube 12 adjacent the first electrode 14, a resistor 28 electrically connected between the second lead-in 22 and the isolated pin 24. A spark gap G is formed between the first electrode 14 and the isolated pin 24.

When the lamp is energized with high voltage starting pulses, a spark occurs between the isolated pin 24 and the first electrode 14. As used herein the term "isolated pin" refers to a metal body sealed into the press seal of the arc tube that does not enter the arc tube chamber. In a preferred embodiment of the invention the isolated pin 24 can be the remnant of the hairpin used to construct the electrode feedthrough of the first electrode 14. An exemplary embodiment of a hairpin is shown at 16*a* where it forms the second electrode 16.

A space S exists between the first electrode 14 and the isolated pin 24 and the spark gap G is less than the space S.

Figure 2:
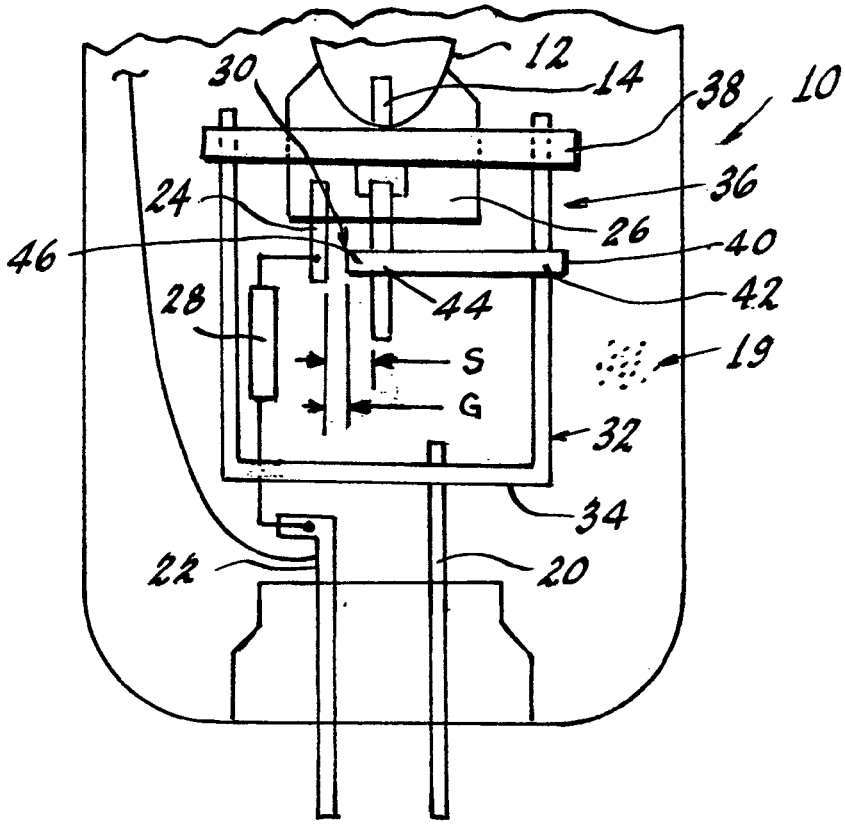
FIG. 2 is a diagrammatic view of an alternate embodiment of the invention with parts eliminated for clarity.

A more particular embodiment is shown in FIG. 2 wherein the arc tube 12 is supported by a frame member 32 having a first end 34 electrically and mechanically secured to the first lead-in 20 and a second end 36 extending away from the first lead-in 20 and including means 38, which can be in the form of a pair of straps as is known in the art, engaged with and supporting the arc tube 12. As in the prior embodiment an isolated pin 24 is sealed in the end 26 of the arc tube 12 adjacent the first electrode 14 and a resistor 28 is electrically connected between the second lead-in 22 and the isolated pin 24. An electrical connector 40, which preferably is ribbon shaped, has a proximal end 42 fixed to the frame member 32, an intermediate portion 44 fixed to the first electrode 14; and a distal portion 46 that terminates in the spark gap G in conjunction with the isolated pin 24 thus forming the means 30. In a preferred embodiment the ribbon is nickel; however, other materials can be used.

Figure 3:
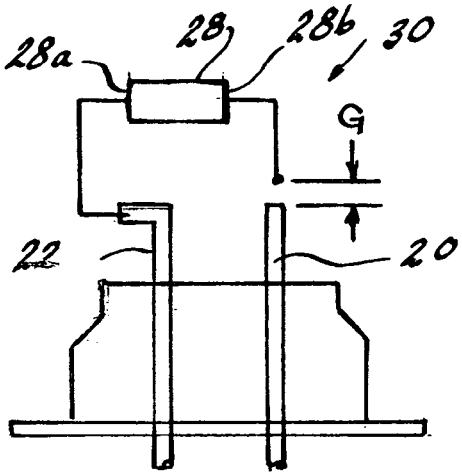
FIG. 3 is a diagrammatic view of another embodiment of the invention.

The invention in its broadest form is shown diagrammatically in FIG. 3 wherein the means 30 comprises the resistor 28 having a first end 28*a* electrically connected to the second lead-in 22 and a second end 28*b* formed in a spark gap G relation with the first lead-in 20.

This latter embodiment can easily be employed where the arc tube construction does not provide an isolated pin.

As mentioned, during starting the igniter of the ballast creates a high voltage pulse that is transmitted across the stem of the leads and then across the spark gap G, causing a small spark to occur. The series resistor 28 limits the current to low values, on the order of 10 milliamperes. While spectral measurements have not been taken, it is believed that the nitrogen spark emits UV from nitrogen molecular bands, which in turn causes liberation of electrons within the arc tube, thus initiating the breakdown process.

Test results, shown below in FIG. 4, illustrate the efficacy of the starting aid with various spark gaps, no UV enhancer, and a control utilizing a prior art UV enhancer.

As can be seen from FIG. 4, the lamps with the starting aid employing the spark gap yielded shorter starting times than either prior art construction, or the construction without a UV starting aid, especially in cold environments (last column on the right in FIG. 4) where there is no possible breakdown within the arc tube from the interaction of the argon fill gas and the mercury vapor additive.

Lamps constructed as above were evaluated for physical damage when left pulsing for ~31,000 seconds. To put this in perspective, if the average time to start is 5 seconds, then the lamp will have lasted the equivalent of 6,000 starts. With a normal cycle of 10 hours per start and 20,000 hours rated life, there would be 2,000 starts. At the end of the evaluation period no visible damage to the starter was observed.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. In an arc discharge lamp having:

an arc tube containing an arc generating and sustaining medium and first and second spaced apart electrodes:

a lamp envelope surrounding said arc tube and a lamp atmosphere within said lamp envelope;

first and second electrical lead-ins sealed within said lamp envelope, said first lead-in being electrically connected to said first electrode and said second lead-in being connected to said second electrode;

the improvement comprising:

means contained within said lamp envelope and exposed directly to said lamp atmosphere for generating a UV-producing spark within said lamp atmosphere.

2. The arc discharge lamp of claim 1 wherein said means comprises an isolated pin mounted in said arc tube adjacent said first electrode and exposed to said lamp atmosphere, a resistor electrically connected between said second lead-in and said isolated pin: and;

a spark gap G between said first electrode and said isolated pin within said lamp atmosphere.

3. The arc discharge lamp of claim 2 wherein a space S exists between said first electrode and said isolated pin and said spark gap G is less than said space S.

4. The arc discharge lamp of claim 1 wherein said means comprises a resistor having a first end electrically connected to said second lead-in and a second end formed in a spark gap relation with said first lead-in.

5. The arc discharge lamp of claim 1 wherein said atmosphere is nitrogen.

6. The arc discharge lamp of claim 5 wherein said nitrogen is present at a pressure of 150 to 400 torr.

7. An arc discharge lamp comprising:

an arc tube containing an arc generating and sustaining medium and first and second spaced apart electrodes:

a lamp envelope surrounding said arc tube and a lamp atmosphere within said envelope;

first and second electrical lead-ins sealed within said lamp envelope;

a frame member having a first end electrically and mechanically secured to said first lead-in and a second end including means engaged with and supporting said arc tube;

an isolated pin sealed in an end of said arc tube adjacent said first electrode and exposed to said lamp atmosphere;

a resistor electrically connected between said second lead-in and said isolated pin: and an electrical connector having a proximal end fixed to said frame member, an intermediate portion fixed to said first electrode; and a distal portion terminating in a spark gap with said isolated pin.

8. The arc discharge lamp of claim 7 wherein said electrical connector is ribbon-shaped.

9. The arc discharge lamp of claim 8 wherein said ribbon is nickel.

10. The arc discharge lamp of claim 7 wherein said atmosphere is nitrogen.

11. The arc discharge lamp of claim 10 wherein said nitrogen is present at a pressure of 150 to 400 torr.

* * * * *